United States Patent [19]

Vercaemert

[11] 4,126,159

[45] Nov. 21, 1978

[54] APPARATUS AND METHOD FOR STABILIZING RAPIERS

[76] Inventor: Gerard A. Vercaemert, 421 Belmorrow Dr., Charlotte, N.C. 28214

[21] Appl. No.: 837,688

[22] Filed: Sep. 29, 1977

[51] Int. Cl.[2] ..... D03D 47/00

[52] U.S. Cl. ..... 139/449; 139/446

[58] Field of Search ..... 139/134, 188 R, 429, 139/437, 440, 443, 444, 445, 446, 449, 450

[56] References Cited

U.S. PATENT DOCUMENTS

| | | | |
|---|---|---|---|
| 2,647,542 | 8/1953 | Purdy | 139/134 |
| 2,810,403 | 10/1957 | Sanderson et al. | 139/449 |
| 3,114,398 | 12/1963 | Pfarrwaller | 139/188 R |
| 3,438,402 | 4/1969 | Kokkinis | 139/449 |
| 3,863,682 | 2/1975 | Filter et al. | 139/188 R |
| 3,957,089 | 5/1976 | Martinelli | 139/449 |

*Primary Examiner*—Henry S. Jaudon
*Attorney, Agent, or Firm*—Bailey, Dority & Flint

[57] ABSTRACT

Magnet means are illustrated carried along the raceboard of a shuttless loom extending within as well as outside the warpshed for exerting a stabilizing force until the opposed rapiers have reached a position outside the warpshed on a return stroke.

5 Claims, 2 Drawing Figures

APPARATUS AND METHOD FOR STABILIZING RAPIERS

BACKGROUND OF THE INVENTION

Erratic motion and breakage of driving tapes for rapier heads on rapier looms has long been a problem resulting in damage to associated loom parts, ends down, excessive maintenance and down time. Such problems have been found upon stroboscopic examination to result from irregular flight paths on the return stroke of the rapiers. The mass of the rapier head causes flexing of the drive tapes with tendency of the remote end of the rapier heads to lift from the raceplate.

This problem becomes more acute at higher speeds and is, therefore, a limitation on loom speeds. It has been found, for example, that utilization of a magnet near the point of maximum flexing of the drive tapes can result in less breakage with increased loom speeds. The inertia force of the rapier head may thus be neutralized. It is believed that by utilizing the invention, 96 inch wide loom speeds may be increased from about 200 picks per minute to from about 230 to 250 picks per minute. Wide looms of 160 inches in width may be expected to operate at from about 180 to 190 picks per minute or more.

The prior art includes patents illustrating the use of magnets for guiding the flight of shuttles during weaving as for example, U.S. Letters Pat. Nos. 2,647,542 and 3,114,398. Patents utilizing magnets for facilitating transfer of yarn from one rapier head to another during weaving include U.S. Letters Pat. Nos. 3,438,402 and 3,957,089, whereas U.S. Letters Pat. No. 3,863,682 illustrates the use of sequentially operated magnets for propelling a shuttle along a race.

SUMMARY OF THE INVENTION

It has been found that the flight of opposed tape driven rapier heads may be stabilized on the return stroke by positioning magnets along the raceboard of a shuttleless rapier loom utilizing suitable magnetic material forming a part of or being carried by the tape or rapier heads to avoid breakage of the driving tape avoiding damage, down time and loss of production.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
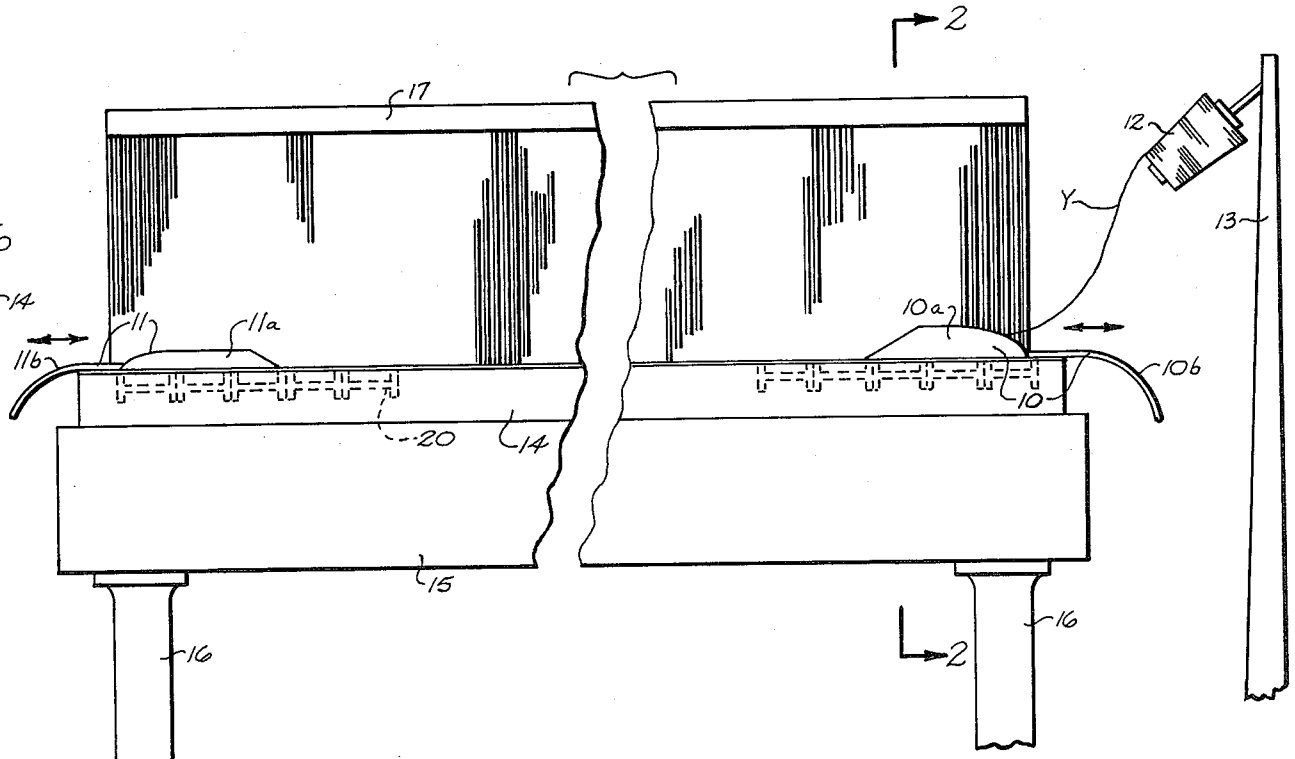
FIG. 1 is a schematic front elevation showing a shuttleless loom equipped with rapiers, illustrating apparatus constructed in accordance with the present invention as well as the method.
Figure 2:
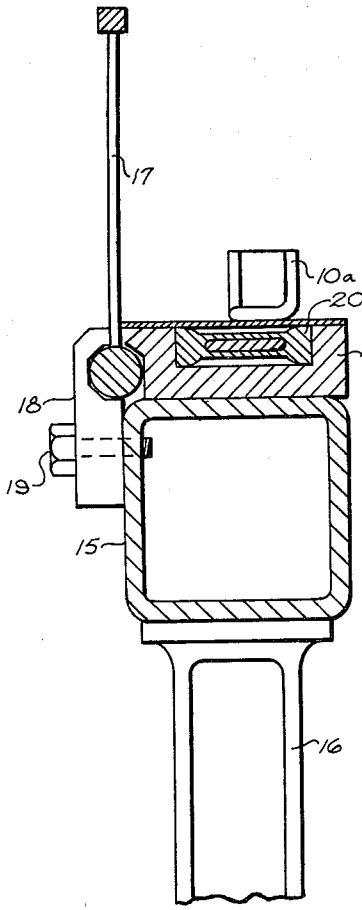
FIG. 2 is a transverse sectional elevation taken on the line 2—2 in FIG. 1.

This invention relates to shuttleless weaving machines which are equipped with two flexible rapiers 10 and 11, introduced from both sides of the warpshed, moving towards and away from each other as indicated by arrows in FIG. 1. One of these rapiers 10 includes a rapier head **10*a* which grips the filling yarn at the beginning of the inward stroke, carries it and transfers it to the other rapier head 11*a* at the moment that the heads of both rapiers come into transfer relation. Typically, the transfer of the filling yarn Y coincides with the termination of the inward stroke. After transfer of both rapiers begin the return stroke to retract to their original positions outside the warpshed as illustrated in FIG. 1** between the rapier heads.

During the return stroke the rapier 10 which introduced the filling yarn, returns empty while the other rapier 11, having received the filling yarn during the transfer, carries the filling through the second half of the shed. When the rapier 11 reaches the end of the return stroke it releases the filling yarn. Subsequent operations including shedchanging and beat-up complete the weaving cycle and lock the filling yarn into the fabric. During these subsequent operations, the rapiers are not operative, although they can be in motion to prepare the start of the next cycle. The start of the cycle is considered the moment that the rapiers begin the inward stroke. The rapiers basically consist of the rapier heads, which contains the elements to grip, carry, transfer and release the filling yarn (not shown) together with the tapes **10*b* and 11*b*** which drive the rapier heads responsive to conventional tape driving elements (not shown).

Each complete cycle of the rapier motion consists of an inward and an outward stroke. During each stroke the rapier is first accelerated and subsequently decelerated. The return stroke is the most difficult to control, particularly from the start of the deceleration until the rapier comes to a complete standstill. The head of the rapier has a substantially heavier mass than the tape. During the return stroke, the heavier head trails the lighter driving tape and during the last portion of the return stroke, which is the deceleration phase, the heavier inertia of the head tends to push the tape, instead of being pulled by it. As a result, the motion of the tape is distorted and frequently the tape completes its return stroke oscillating through the shed. In turn, this erratic tape motion may have repercussions on the motion of the rapier head. Several seriously adverse affects are possible. On the one hand, excessive stresses may be created at the connection point of head and tape, resulting in rupture. On the other hand, the erratic motion of both the rapier head and the tape, may interfere with the warpshed and cause an excessive number of broken ends.

The erratic motion of rapier head and tape also could be the result of the pulling force not being in line with the center of gravity of the rapier head. Considering the flexibility of the tape and rapier head assembly, as well as its geometric configuration, the pulling force may be out of line with the center of gravity practically at any given moment during the return stroke. As a result, the return motion of rapier and tape assembly may be distorted and vertical deviations from the regular straight path may occur.

In the drawing, the yarn Y is illustrated as being withdrawn from a package 12 carried by a suitable creel 13. The rapiers are carried on the usual raceboard 14 on the lay 15. The lay is carried by the usual swords 16 for oscillation back and forth during weaving. The reed 17 is illustrated as being secured upon the lay by a suitable bracket 18 and fastener means 19.

The purpose of the present invention is to correct the erratic motion of the rapier head and the tape, whatever the cause may be, by exerting an opposing force during the return stroke. The result of the opposing force is to minimize or to nullify the effects of the inertia of the rapier head and to keep the motion straight. The opposing force actually holds back the rapier head during deceleration, so that the resulting inertia of the rapier head and does not push the tape into erratic motion. Instead of being subject to adverse inertia forces, the motion of the rapier is controlled by balancing forces during the return stroke and particularly during the portion on which deceleration occurs.

The opposing force is generated by a magnetic field, which comes into being every time the rapier head reaches the stage where deceleration starts or where corrective action seems required. By forcing the rapier head or tape to cross a magnetic field, the metallic parts of the head or tape being of magnetic material, become subject to a force in the opposite direction of the rapier movement. The metallic parts of the head or tape may be the usual working parts of metallic parts or metallic parts may be added in any form, for the purpose of generating the opposing force.

The magnetic field may be created by any known method. For example, the magnetic field can result from energizing a single or several electromagnets 20 embedded in the raceboard 14. If several magnets are used they can be energized simultaneously or in sequence as illustrated by the magnets of U.S. Pat. No. 3,863,682 referred to above. The method of energizing in sequence could result in optimum opposing force, if the energizing of each subsequent magnet takes place at the moment when the rapier head reaches the zone of that particular magnet. In certain applications and under certain circumstances, particularly with narrow looms, a permanent magnetic field may suffice.

While a preferred embodiment of the invention has been described using specific terms, such description is for illustrative purposes only, and it is to be understood that changes and variations may be made without departing from the spirit or scope of the following claims.

What is claimed is:

1. Apparatus for stabilizing the driving tapes of weft inserting rapiers on the race board of a shuttleless loom, during the return stroke from a position centrally of the race board to an original position outside the warpshed, comprising:

magnetic material carried by said rapiers, magent means carried by said race board and extending from a point within the warp shed is a point adjacent each end thereof; and said magnet means extending along said race board in alignment with the path of the rapiers so as to exert a stabilizing force upon the tape during slowing when the rapiers and approaching said original position outside the warpshed.

2. The structure set forth in claim 1, wherein said magnet means are carried within the race board.

3. The structure set forth in claim 2, wherein said magnet means includes a plurality of electromagnets adjacent each end of said race board for sequential operation as a rapier moves adjacent on electromagnet on its return stroke.

4. The method of stabilizing the driving tapes of weft inserting rapiers on the race board of a shuttleless loom, on the return stroke of said rapiers from a position centrally of the race board to an original position outside the warpshed, comprising:

exerting a magnetic force extending along the path of said rapiers along said race board from within said warpshed to a point outside said warpshed so as to stabilize the rapiers until they have reached said original position outside the warpshed.

5. The method set forth in claim 4 including exerting said magnetic force as a plurality of electromagnetic forces adjacent each end of said race board in sequence as a rapier moves adjacent an electromagnet on its return stroke.

* * * * *